United States Patent [19]

Bevan

[11] Patent Number: 4,812,273

[45] Date of Patent: Mar. 14, 1989

[54] MOULDING OF CONSTRUCTION PRODUCTS BY VIBRATION AND PRESSURE APPLICATIONS AT RELATIVELY SMALL INTENSITIES

[75] Inventor: Christopher G. Bevan, Corby, United Kingdom

[73] Assignee: C. G. Bevan Associates Limited, Northhamptonshire, England

[21] Appl. No.: 928,060

[22] Filed: Nov. 7, 1986

[30] Foreign Application Priority Data

Nov. 7, 1985 [GB] United Kingdom ..... 8527491

[51] Int. Cl.[4] ..... B28B 1/08; B28B 1/10; B28B 7/32

[52] U.S. Cl. ..... 264/71; 264/128; 264/314; 264/333; 425/417

[58] Field of Search ..... 264/71, 314, 333, 128, 264/133, 69; 425/417

[56] References Cited

U.S. PATENT DOCUMENTS

| | | | |
|---|---|---|---|
| 2,052,818 | 9/1936 | Freyssinet et al. | 264/314 X |
| 2,311,358 | 2/1943 | Baily | 264/71 |
| 3,770,859 | 11/1973 | Bevan | 264/71 |
| 3,833,331 | 9/1974 | Springs | 264/71 X |
| 3,917,781 | 11/1975 | Gabriel et al. | 264/71 |
| 4,119,695 | 10/1978 | Asserback | 264/314 |
| 4,690,791 | 9/1987 | Edmiston | 264/71 X |

FOREIGN PATENT DOCUMENTS

| | | | |
|---|---|---|---|
| 2526166 | 12/1976 | Fed. Rep. of Germany | 264/71 |
| 243468 | 10/1969 | U.S.S.R. | 264/71 |
| 485874 | 1/1976 | U.S.S.R. | 264/71 |
| 2045150 | 10/1980 | United Kingdom . | |
| 2067125 | 7/1981 | United Kingdom . | |

*Primary Examiner*—Jan H. Silbaugh
*Assistant Examiner*—Karen D. Kutach
*Attorney, Agent, or Firm*—Fisher, Christen & Sabol

[57] ABSTRACT

A method for the manufacture of cored construction products from dry particulate materials including feeding the materials into a vibrating mould so as to bring the same into pre-compacted condition, and subjecting the materials when in such condition to a transverse pressure so as to effect final compaction thereof. After compaction, a free standing surface of the material is impregnated with a setting liquid. The vibration is of such frequency and amplitude as to bring the individual particles into substantially uniform closely spaced disposition, the subsequent application of pressure bringing the material into a compacted state without any substantial re-arrangement or crushing of the particles.

11 Claims, 2 Drawing Sheets

MOULDING OF CONSTRUCTION PRODUCTS BY VIBRATION AND PRESSURE APPLICATIONS AT RELATIVELY SMALL INTENSITIES

The invention relates to the moulding of articles and in particular to the moulding of construction products, such as partition panels, roof decking and pipes, from liquid setting particulate material. More particularly the invention concerns an improvement in or an alternative to the methods described in British Pat. Nos. 1,346,767, 2,045,150 and 2,067,125.

In the methods disclosed in the prior patents aforesaid dry powders or powder/fibre mixtures are fed at a controlled rate into moulds containing vertical core formers and are compacted by vibration. After filling, the formers are withdrawn, leaving clear, vertical core voids within the compacted powder, the powder then being set by applying a suitable setting liquid to the free standing vertical powder surfaces of the core voids.

Central to these processes is the degree of stability of the dry packed materials, a high degree of stability being necessary for the free standing powder to withstand the disruptive effects of withdrawing the core formers and of being sprayed at close quarters from within the core voids. It was found that such stability could only be obtained if the particles were packed closely round fibres provided in the mixture and/or if the fine particles substantially filled the interstices between coarse particles. The mechanical interlock resulting from such distribution of coarse and fine particles and, where present, the fibres, is sufficient to cause the material in the web between the core voids to arch between the mould sides, and the webs thus remain standing after removal of the support of the core formers.

In order to achieve the aforesaid essential interlock and arching the mould is subjected to heavy vibration during the filling operation, such vibration overcoming the inherent difficulty in getting particles which are specifically required to arch or block in the mould also to flow into the mould and round each other so as to achieve the degree of required packing.

Although effective in promoting both flow and compaction, increasing experience has shown that the intense vibration characteristic of the methods of the prior patents gives rise to practical limitations to the use of such methods. For example, it is difficult to apply the method of British Pat. No. 2067125 to the production of storey-height building panels using the relatively large multi-cell moulds required for production on an economic commercial scale, since the considerable vibration intensity needed to move the large mass of such moulds is well outside the normal range of commercially available vibrators. Using a multiplicity of vibrators causes serious problems in maintaining uniform vibration characteristics in each mould cell, particularly with the high frequency vibration used in these methods, such vibration characteristics being sensitive to small variations in clamping force between various parts of the mould structure. With such high levels of vibration there are also potential problems with metal fatigue, which adds to the difficulty of scaling up these methods for mass production.

The alternatives to very heavy vibration adopted in other prior art methods involve the application of pressure instead of vibration to compact the powder, or a combination of pressure and vibration. However, in all such processes the inherent clogging or arching properties of powders suitable for achieving dry stability also resist flow under direct pressure, and prevent the rearrangement of particles needed to optimum compaction. In order to achieve sufficient interlock, such alternative prior art methods require either sufficiently high pressure such as will, in effect, crush the particles into close array, or the pressure is accompanied by vibration applied in such a way that the arching developed during compaction is continually being dislodged while the pressure is applied.

Both the direct pressure or the combined pressure/vibration methods do, however, have serious practical disadvantages. Thus, in the case of applying pressure alone, the magnitude of the forces needed to overcome arching resistance and to achieve close interlock by crushing or particle deforming limits the method to very small form pieces, and the whole idea of pressing the large dry powder form pieces required for construction products to the degree required for safe core former withdrawal and subsequent spraying of practical equipment. We have found that these very high forces can be reduced by applying arch breaking vibration simultaneously with pressure, but, for this to be effective, the surfaces of the mould and core former which define abutments for the powder arches need to move relative to each other to collapse the arches, such movement posing serious problems of wear to and leakage of powder from the mould under practical production conditions. Application of pressure to a powder in a static mould, which powder has been fully compacted by vibration, would, of course, serve no useful purpose.

According to the present invention, the method for the manufacture of cored construction products from dry particulate materials, which may include fibres, comprises the steps of providing a mould having at least one core former therein, vibrating the mould whilst progressively filling the mould with an appropriate mix of said materials, applying pressure to the material in the mould, withdrawing each core former to leave a corresponding core void, and applying a sufficient quantity of setting liquid to a free surface of said material to give full impregnation thereof by capillary action, is characterised in that the vibration is such as to effect pre-compaction of said materials, and the pressure is applied to the material as so pre-conditioned in order to effect final compaction thereof.

By pre-compaction is meant the re-arrangement of the individual particles of the dry particles material into substantially uniform, closely spaced disposition such as to be capable, on subsequent application of pressure, of being brought into a final compacted state without substantial redistribution or local crushing of the particles.

In the light of past proposals as hereinbefore set forth, the result achieved by the present invention appears to cut across all prior experience, vibration and direct pressure both being used but at relatively small intensities and in such manner that the vibration has no arch-breaking function when the pressure is applied. In the present invention, the powders and fibres are vibrated during mould filling as in British Pat. Nos. 2,045,150 and 2,067,125 but with almost 1/10th of the vibration intensity, and final compaction is achieved by applying an amount of direct pressure which is a small fraction of the amount needed to deform the particles after the mould has been completely filled. The vibration used is not required to dislodge arching during the application of pressure, and can be applied with both the mould sides and core formers locked together to avoid wear and leakage problems from differential movement during vibration. Neither the vibration nor the pressure alone would be sufficient to effect the required degree of final compaction, but when both are used in combination in the manner described in the specification hereunder, it is possible to achieve the close packing needed for safe core former withdrawal and hydration spraying. Furthermore, unlike the previous methods, the present method is effective with vibration and pressure intensities which are comfortably within the range of ordinary engineering practice for making large building products. In addition to there being no requirement for mould parts to move relative to each other, the vibration movement as a whole can be quite coarse, thus avoiding the very close clamping tolerances required in the earlier high frequency methods.

According to a preferred feature, the invention includes the step of applying pressure to the pre-compacted material by expansion of the or each core former, thereby to provide the unformity of compaction needed for reliable core former withdrawal.

According to a further preferred feature, an expandable sleeve is provided about each core former, and the pressure applying step includes the inflation of each such sleeve.

According to another preferred feature, expandable, sleeved formers of similar kind to the core void formers are reinserted into the core voids after the powder has been sprayed, and additional pressure is applied to the dampened powder, so that the relatively unsupported material between the webs is pressed firmly against the mould sides, thereby flattening out any surface imperfections which may arise during spraying. This step has important commercial significance for the method of the invention, as the latter is more prone to give rise to slight surface imperfections than are the earlier methods involving heavy compaction by vibration alone.

The invention also includes apparatus for use in practising the method aforesaid, such apparatus comprising a mould, a mould cavity defined by the mould, at least one elongate core former removably engageable with the said mould cavity, vibration means operating substantially in the axial direction of the core former or formers and adapted, upon actuation, to effect pre-compaction of the contents of the mould, the core former being expandable in a direction transversely thereof and being adapted, upon expansion, to effect compression of the contents of the mould, and hydration means including at least one setting liquid delivery element mounted for reciprocatory motion in the mould along a path identifiable with the position occupied by a respective core former when present in the mould.

According to a preferred feature, the or each core former includes an inflatable sleeve arranged coaxially therewith.

The invention will now be described further, by way of example only, with reference to the accompanying diagrammatic drawings illustrating one embodiment thereof and in which.

Figure 1:
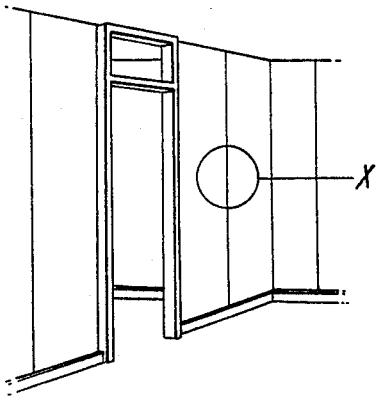
FIG. 1 is a perspective view of an internal wall comprising storey-height building panels.

Referring now to the drawings, a wall panel constructed in accordance with the method of the invention comprises a rectangular body 11 of constant thickness having a plurality of substantially parallel core voids 12 extending in the direction of the major dimension thereof to define webs 13 which extend between and connect the opposite sides 14, 15 of the panel. The opposite longitudinal edges 16, 17 of the panel are respectively provided with cooperable male and female formations 18, 19 each for engagement with a complementary formation of the next adjacent panel of an assembled wall.

The rectangular body 11 is typically 2.4 meters high, 0.6 meters wide and 40 mm thick, whilst the thicknesses of sides 14, 15 and webs 13 are typically 6 mm.

Figure 3:
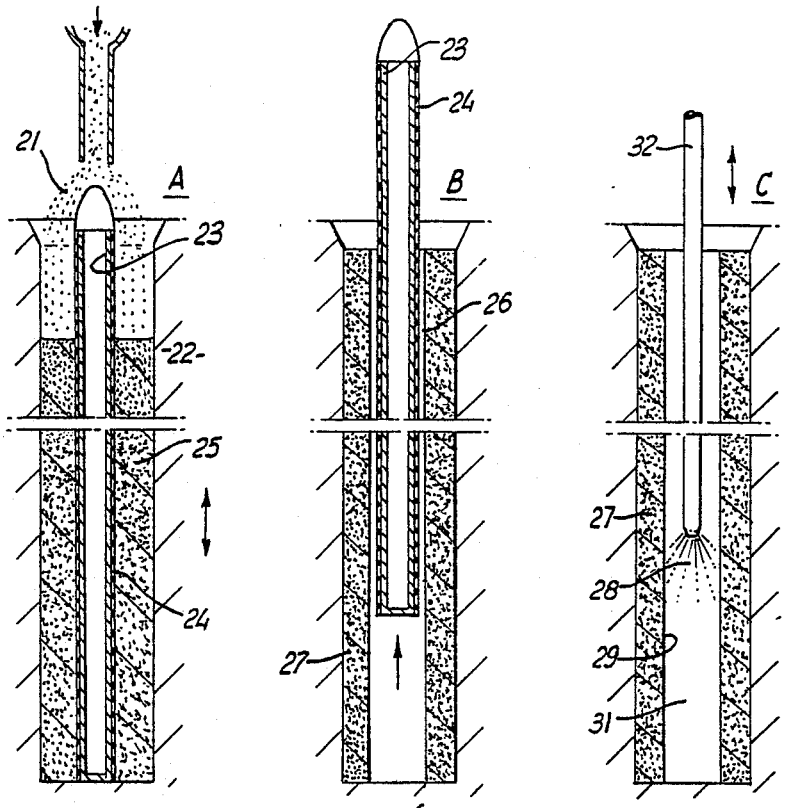
FIGS. 3A, 3B and 3C illustrate the mould filling, core withdrawal and spraying steps of the method of the invention.
Figure 4:
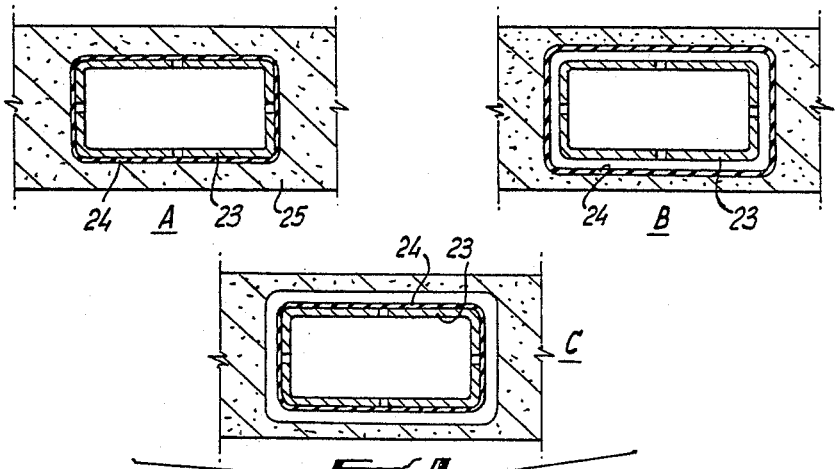
FIGS. 4A, 4B and 4C illustrate successive stages of the pressure application step of the method of the invention.

The method is illustrated in FIGS. 3 and 4 of the drawings and in accordance with such method, a powder or powder/fibre mixture 21 is fed evenly to the top of a vibrating mould 22 having one or more hollow, vertical core formers 23 located therein, each said former 23 being hollow and having an expandable sleeve 24 arranged coaxially thereon.

On completion of the filling operation, during which the mould 22 is continuously vibrated so as to cause the material 25 therein to settle and assume a regular distribution with some arching between various of the particles of the material, each sleeve 24 is inflated so as to apply pressure to the material 25 and thereby effect compaction thereof. Vibration can be continuous throughout the compression step but this usually has no noticeable effect, unless the vibration is applied in the specific arch breaking modes described later which fall outside the scope of the present invention.

After compaction, the air pressure within each sleeve 24 is released and such sleeve 24 collapses onto the core former 23, thus creating a slight clearance 26 between the outer surface of the sleeve and the compacted material 27 present in the mould.

The core former 23 is withdrawn, as illustrated by FIG. 3B, and setting liquid is applied to the wall 29 of the core void 31 in the compacted material 27 by a spray tube 32 in conventional manner, the setting liquid 28 being supplied in an amount sufficient to wet the compacted material 27 throughout by capillary action.

The product can then be demoulded and allowed to set, again in accordance with conventional practice.

FIG. 4 illustrates the successive stages of the compression step, FIG. 4A showing the pre-compacted material 25 in contact with sleeve 24 and the latter lying against the core former 23. In FIG. 4B sleeve 24 is shown in inflated condition and in spaced apart disposition relative to the core former 23, whilst in FIG. 4C sleeve 24 is again shown in contact with the core former 23 after release of the pressure air from within the sleeve to give the clearance 26 between the sleeve 24 and compacted material 27.

By utilising a pre-conditioning step involving vibration of the material in combination with a subsequent compaction step it has been found possible to achieve a requisite degree of stability of the dry packed materials without recourse either to intense vibration or to high compacting pressure, although the correct degree of vibration pre-compaction is critical to the effectiveness of the pressure compaction step.

It would seem that the vibration to an extent sufficient to give regular distribution of the particles or material with sufficient interlock between individual particles is required, so that subsequent application of pressure can further compact the material without requiring substantial redistribution of particles. With too intense a vibration the material will tend to flow and pack into an unyielding mass, with the result that the modest pressures used for inflating the core formers have no effect, and all the compaction is effectively provided by vibration as in the earlier patents, and is thus outside the scope of the present invention. Material subjected to too little pre-conditioning (or pre-compaction) by vibration will be further compacted by application of pressure, but it has been found that the resultant mouldings are too weak and marred by surface cracks to be commercially acceptable. It would be possible in such circumstances to overcome the latter faults by using very high pressure, but the pressures required approach the order of magnitudes of those required for the "pressure only" methods described more fully later, and likewise fall outside the scope of this invention. Essentially, the object of vibration is to condition the powder or powder/fibre mix so that subsequent low pressure final compaction is effective, which is in complete contradiction to the methods disclosed in prior British Pat. Nos. 2 045 150 and 2 067 125 where the materials are wholly or substantially compacted by vibration. The exact reason why pre-compaction is so important is not fully understood; possibly the vibration re-arranges the particles and fibres (when present) so that they more readily mesh together under subsequent pressure. The vibration also settles the particles around the fibres with the minimum of local voids or loose zones which would otherwise be shielded from pressure by bridging or arching effects.

The effect of vibration on fibre positioning also appears to be important. This arises particularly with the thin-webbed, hollow cored products for which the method was principally developed, which, in the case of glass-fibre reinforced gypsum partition panels, can involve the feeding of 50 mm long fibres into mould gap widths of as little as 5 mm. Sufficient vibration is required to skew these fibres round into an orderly layered disposition with the minimum of bends of kinks which could disrupt the powder when the core void formers are removed. Although such re-arrangement achieved by pre-compaction may not be complete, it appears to reduce the movement needed in the subsequent pressure phase to the level where fibre springing is not a problem.

Another factor which may be relevant to the need for vibration pre-compaction is the volume of air trapped between the particles of the mix on filling of the mould. The powders used in practising the method have a high resistance to air flow, and loose packed powder in tall, narrow moulds can trap a considerable volume of air. With no easy escape route, this trapped air could give rise to a back pressure sufficient to reduce the effectiveness of any applied pressure. With adequate vibration pre-compaction, however, the volume of trapped air may be reduced to a level where the applied pressures are sufficient to overcome the much reduced back pressure arising from this source.

Air back pressure effects may be one of the reasons why the method of the invention appears to be more prone to surface imperfections in the finished product than the earlier methods where air is progressively expelled under intense vibration during a slower filling cycle. The back pressure appears to lift the powder mass very slightly away from the mould sides, usually in patches related to the areas where the water seeps through last to the mould face, the air pockets trapped by surrounding damp material forming the surface blemishes.

In order to avoid the surface blemishes as aforesaid or other surface imperfections, howsoever formed, the invention may include the further step of subjecting the powder to a further pressure application after wetting.

Thus, in accordance with this further proposal, pressure is applied to the dampened powder before it has set, so as to press the material against the mould sides and thereby flatten out any surface imperfections in the finished product, a pressure of, say, 50 psi being found to be sufficient. The pressure will ordinarily be applied by post-hydration cores comprising sleeved formers of similar design to core void formers 26, but the sleeved formers are generally of slightly smaller cross-section to ensure that the same can easily re-enter the core voids without damaging the dampened powder. In the case of quick setting powders like gypsum, such re-entry and pressure application should be initiated while the material is still sufficiently unset to deform under pressure. After expanding the sleeves sufficiently to remove any surface imperfections, the sleeves are retracted and the sleeved formers are removed without any necessity to await setting of the material. Subsequent steps of setting and demoulding are then as for conventional practice.

Whereas, in the case of the method disclosed in the prior specifications aforesaid, vibration frequencies of between 3000 and 12000 cycles per minute were utilised to achieve full compaction, vibration at substantially lower frequencies is appropriate to the present method, and most types of vibration or mould rapping equipment can provide the relatively modest degree of pre-compaction required in such context.

With the very slender core formers required for making storey-height building panels, it is usually necessary for the vibrations to be unidirectional along the vertical axis of the mould, thus avoiding lateral oscillation of the formers, and consequential adverse effect on quality.

It has also been found to be of practical advantage to lock the core formers to the mould, so that the same vibrate in unison without any relative movement therebetween such as might give rise to rubbing and wear.

A simple cam vibrator operating at, say, 400 to 600 cycles per minute has been found satisfactory.

With a reasonably sharp termination of the downstroke, such as arises from a cam/anvil vibration arrangement, an amplitude of vibration of, say, 1.5 mm is adequate, as compared to an amplitude of 15 to 20 mm required for this type of low frequency vibrator in order to give the same levels of compaction achieved by the high frequency vibration used in the prior methods. Although the optimum amplitude of vibration will vary according to the powder mix involved, an increase in amplitude to, say 3 mm can give a level of compaction in certain circumstances sufficient to prevent removal of the core formers, unless very high pressures are used to inflate the formers. On the other hand reduction in amplitude of vibration to below 1 mm can give rise to problems, in that vibrations of such magnitude may be found insufficient to dislodge bunches of fibres which form in the narrow apertures in the mould and may give sufficient pre-conditioning for the subsequent pressure stage to be effective. In the absence of fibres, the optimum amplitude will ordinarily be reduced.

It is to be observed that the frequency and amplitude of vibration necessary to give adequate settlement of the mix will vary according to the mix and to the type of vibration used, and the operating amplitude, for example for a conventional eccentric weight vibrator as used in previous methods operating at, say, 12,000 cycles per minute, will be only a very small fraction of a millimeter. Generally, however, the much cruder low frequency vibration described earlier for the present invention is preferred, as this places much less onerous tolerances on how well the moulds are constructed and clamped to the vibrating source. This latter point is of major practical significance when using multiple cell moulds, where the degree of clamping uniformity needed for high frequency vibration, if achieveable at all, can only be achieved, at great cost.

Final compaction of the pre-compacted material is achieved by application of pressure, such pressure ordinarily being applied after cessation of the vibration of the mould. Pressures of between, say, 50 and 65 psi have been found to given an appropriate degree of compaction, although pressures as low as 15 psi have been found to work in some circumstances. Pressures above 65 psi can improve product quality, but with correct vibration pre-conditioning, there appears to be no advantage is using pressures much in excess of 100 psi.

Figure 2:
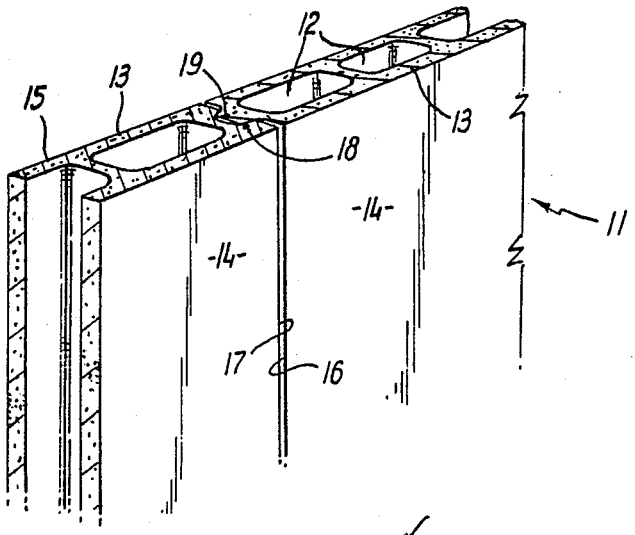
FIG. 2 is a perspective view showing the wall cross-section at X in FIG. 1.

The effectiveness of the pressure utilised depends to a large extend upon how it is applied, and it has been found that simply moving the mould sites inwardly is not satisfactory in the context of the manufacture of thin-webbed, hollow cored partition panels of the kind shown in FIG. 2. Indeed, effective compaction of the webs requires that the core formers be moved towards each other or that the formers expand within rigid mould faces. It is to be observed that, on inflation, the sleeve provided about the core former in the arrangement shown in FIGS. 3 and 4 of the drawings expands laterally in all directions, against the material of the mix, to give a two dimensional application of pressure rather than the one dimensional application which arises when the mould sides are moved inwards.

Moving the mould sides inward to effect some additional compaction after vibration was considered in prior British Pat. No. 2045150 but was said to be usually not necessary. This was partly because, as described above, pressure applied in this way was not very effective, but also because most of the compaction in that method had already been achieved by vibration, leaving no scope for the relatively modest pressures available for large form pieces to be effective. Generally the thinking at that time was that arching effects made pressure methods inherently unsuitable for achieving the degree of particle interlock needed for the process to work effectively, and this was strongly reinforced by the then practical experience. It was only after completely redesigning the entire mould and core former assembly and introducing the additional feature of expandable sleeves, that it was possible to try the concept of the present invention.

The earlier thinking remained firmly entrenched even when some of the then conventional methods were extended to include some degree of pressure compaction along with the vibration. For example in United Kingdom Pat. No. 2045150, pressure was used in the limited comtext of a particular powder mix having a high proportion of pulverised fuel ash (PFA) and a limited proportion of coarse particles. However, notwithstanding any contrary indication in the specification, compaction was nevertheless achieved largely by vibration applied to an extent sufficient and in a manner specifically designed to destroy any arching between the coarse particles thus removing a primary source of resistance to applied pressure. In this prior method the load or pressure is applied vertically downwards onto the top of the mix rather than laterally onto the whole mould area and has the object of compensating for the lack of "head" of overlying material. It is the vibration of the cap or plunger moving relative to the mould sides which provides the arch breaking action throughout the mix and extends the effectiveness of the top compaction into lower parts of the mould. Indeed, the vibrating cap or plunger may be equated to a tamping tool operating at high frequency and exerting pressure along the vertical axis in the direction of the core formers, rather than laterally between the formers and the mould sides. This together with the shearing action due to the differential movement represents a completely different concept from that of the present invention.

The lower limits of pressure for the method of the invention vary according to powder mix filling rates and vibration settlement. Pressures of around 15 psi can give satisfactory mouldings from the processing stability point of view, but usually higher pressures give much better quality end products. It should be noted that the pressures quoted relate to the air pressure in the core void formers, the pressure exerted on the powder being somewhat less due to the elastic restraint of the sleeves. For typical synthetic rubber sleeves of around 1.4 mm thick these differences are small, but if stiffer, thicker walled elastomers are used, the internal pressures should be increased accordingly. In all cases the uniformity of wall thickness and elastic properties are important, otherwise webs can be displaced by one sleeve pressing harder than its neighbour.

The movement of the pressure sleeves against a typical vibration pre-conditioned gypsum mix is around 0.5 mm. For a typical wall thickness of 6 mm, this represents an average compression movement of around 10%, and rather more for the upper part of the mould, where pre-conditioned can be less effective due to the lack of a head of material during vibration. The clearance gaps right at the base of the mould are usually less than the average, due to higher local vibration pre-compaction and the local restraining effect of the end fixing of the pressure sleeve.

These clearance gaps of around 0.5 mm all round the core formers are in marked contrast to the very tightly embedded formers in the earlier methods. For the 2.4 mm long formers used previously, it was necessary to take great care regarding the surface smoothness and degree of taper of the formers, and in addition release of the mould sides was normally required in order to withdraw the core formers at all. It was also usually necessary to relieve the shear forces on the powder webs between adjacent formers by withdrawing the formers individually, or by pulling alternate formers separately. These features complicate production equipment but are not necessary in the present invention. Instead of requiring a smooth taper in one direction, with the present invention it is even possible to vary the cross-sectional dimensions of the core formers in the reverse direction to compensate for the slight variations in sleeve movement described earlier. This compensating reverse taper can result in a constant wall and web thickness throughout the length of the product, which is a feature difficult to achieve.

In the present invention it is extremely important to avoid or minimise mould side deflection or bowing during the pressure compaction stage, since this can extend and crack the webs. On removal of internal sleeve pressure, the mould sides revert to their unbowed form. Mould deflection during the pressure compaction step usually requires that the mould deflection be limited to, say, no more than 0.1 mm. This is a very small deflection by normal standards and powder collapse from this usual requirement played a considerable part in preventing the earlier development of the present concepts.

In order to avoid or minimise deflection, and thus the adverse consequences thereof, the mould faces are held against material deflection during the pressure compaction step by support means defined by respective arrays of inflatable tube-like bodies at each mould face, the said bodies operating against a rigid reaction surface, on inflation and making pressure contact with the said faces.

In the manufacture of pipes by the method of the invention, the circular shape of the mould casing in inherently capable of sustaining high pressures without deflection, and in such context compaction pressures of 80 psi and above, may be used without giving rise to serious problems associated with mould deflection.

It should be noted that even with these higher pressures, the order of magnitude involved is in complete contradistinction to pressure normally used in other powder moulding processes where no vibration is used. For example in the manufacture of pharmaceutical tablets and in powder metallurgy, the pressures involved are typically 20,000 to 100,000 psi and are so high that, although such methods can be used in the production of very small form pieces, their use in the context of the immeasurably larger construction products of the kind to which the present invention is directed, is wholly impractical due to the press sizes required being many orders of magnitude outside the normal average. Generally the pressures used in these methods (such as for the manufacture of pharmaceutical tablets or form pieces made by powder metallurgy techniques) are above the crushing or deforming strengths of the particles involved, and it is thought likely that local failure of the material contributes significantly to achieving the particle interlock needed for dry form stability.

Direct pressure has also been used for gypsum powder in U.S. Pat. No. 1,427,103 to manufacture buttons by a method which involves subjecting gypsum plaster to pressure to produce a dry form piece. However as in the case of the manufacture of pharmaceutical tablets which are of a similar order of sizes, the pressure involved has to be extremely high to permit of complete demoulding of the dry form piece, and also to transform the normally soft Plaster of Paris into the abnormally dense rock-like material needed for a viable button. It is estimated that the application of the method of U.S. Pat. No. 1,427,103 to the production of a construction product, for example a 2.4 m×1.2 m building panel, would require a press capacity of approximately 50,000 tones, and would thus involve manufacturing equipment well beyond the range of normal engineering practice. The only conclusion which can properly be drawn from the prior art is that, whilst compaction of powders to provide a stable demouldable product can be achieved solely by use of pressure, the magnitude of the pressures is such that the method cannot be used for construction products of the kind to which the present invention is directed.

The method of the present invention is applicable to the same wide variety of liquid setting powders and inert fillers described in prior British Pat. Nos. 1346767, 2045150 and 2067125. These consist principally of water setting powders, such as gypsum hemi-hydrate and Portland cement, and fillers such as expanded Perlite, sand and pulverised fuel ash. Although the choice of raw materials is very wide, the form in which they can be used in the process must be closely controlled, particularly as regards particle size grading and flow characteristics.

In general the grading of the fine particles in the mix is much finer than in the earlier methods and special care is required to achieve the required arching or clogging properties for dry stability. For example, whereas it would previously have been sufficient to describe "fines" as 100 microns down to dust, in the present context it is usually also necessary for the very small particles (e.g. 5 microns and below) to be retained rather than being blown off in cyclones or dust collecting equipment.

For a normal beta hemi-hydrate gypsum the specific surface area for the total fines would typically be around 5800 $cm^2$/gramme, which is finer than most standard cement powders. Particle shape and grading with the fines mix is also important, and the above figure is for the angular shapes obtained by grinding or beating the powder, which would thus contain a range of particle sizes, rather than for example a uniform grade of relatively spherical shapes.

As with the earlier methods it is also normally necessary to include a proportion of relatively large diameter, very free flowing coarse particles to help compact the fines during vibration precompaction, and to make the filling shutes reasonably self-scouring. The particle size specificatioon for these relatively very coarse particles is less critical than for the fines, but the proportion in the total mix should be limited to no more than needed to achieve the required level of vibration pre-conditioning. In the case of the 5800$cm^2$/gramme fines described above, a typical coarse fraction with particles between 300 and 2000 microns, would generally not exceed around 28% by weight of the total mix (assuming roughly equivalent densities).

It should be noted that this relatively small proportion of coarse particles is the complete reverse of the proportions in the earlier method in British Pat. No. 2,067,125, where the coarse fraction usually makes up the greater part of the mix.

The correct balance of coarse and fine particles can only be obtained by practical testing in purpose designed equipment, and optimum mixes can be quite different for different types of material. For example, if the fines are alpha hemi-hydrate crystals of a needle-like shape, particle size can be larger, as dry stability can be markedly improved by the inherent interlocking nature of such shapes. In some circumstances the need for a radically larger diameter coarse fraction may not arise. At the other end of the scale, some very fine particles like pulverised fuel ash, may have about the right particle size, but contain a large proportion of spherical shapes which can adversely affect dry stability. In such cases it may be necessary to introduce a degree of mechanical fracturing to increase particle angularity.

Likewise, generally the same wide range of fibres and continuous reinforcement described in the prior patents aforesaid can be used in the method of the invention. Less stiff fibres are preferable but most grades of ordinary glass fibre can be used. Feeding can be by conventional fibre cutters synchronised with the powder feeder to give the desired fibre content. Some types of fibres can be mixed in with the powder, but for gypsum matrices this generally can only be done with fibre lengths which are too short to provide effective reinforcement for the end product. Fibres can be omitted which do not require reinforcement, although this places reliance on correct particle size formulation in order to achieve adequate dry stability.

The feed rates of the gypsum powder mix described earlier are generally set to give a mould filling rate of between 15 and 20 mm per second. This is much faster than for the earlier methods, as it is neither necessary nor desirable to allow sufficient time for all the air in the mix to escape, or for the parties to pack into their optimum close configuration. The combination of faster filling rates, less free flowing powder mixes and reduced vibration in the present invention, however, places much greater emphasis on accurate feeding into the mould than was previously the case. There are numerous established methods of showering particulate materials and fibres evenly, although such methods are usually designed to distribute onto horizontal beds for flat sheet production. Typically established methods include vibrating tray distributors, traversing delivery shutes, or rotary vane distributors. With suitable adaptions, any of these methods are suitable in principle but all require particular care in their design to achieve the levels of accuracy needed. For example, in the case of delivery shutes which transverse back and forth over the mould, it has been found that ordinary compressed air actuators did not give sufficient control over traversing velocity or stroke, and that such as electric motor actuators with accurate electronic controls or stepper motors on reversing ball screws were required.

It is important to appreciate that all the process parameters discussed earlier affect each otehr, and this inter-relation makes it difficult to define clear boundaries for each individual variable. Clear sets of operating parameters for practical production can be established, but these are limited to specific combinations, which can normally only be determined by conducting a series of tests using full scale equipment specifically designed for this purpose. Such equipment will normally have all the features described earlier for a production plant, but would incorporate more extensive monitoring equipment and have transparent mould sides to enable filling and hydration characteristics to be observed directly.

A typical test sequence for an unfamiliar raw material would start with a preliminary assessment of the powder clogging characteristics before using the test plant. Most suitable fine powders will form a fairly stable lump when a handful is pressed between fingers and palm, and a degree of such stability should also be present when the coarse particles are added to the mix. If the material does not "ball" in this way or the lumps so formed break up too easily, the fine powder particles should be further reduced in size and/or the proportion of coarse particles reduced. This pre-assessed mixture together with the required proportion of fibres, is then fed into the mould at a fairly arbitrary initial rate of around 20 mm per second, with a typical vibration amplitude of around 1.5 mm.

During filling, the material is closely observed through the transparent mould sides to check that the vibration is sufficient to dislodge any fibre bunches, and that the material settles uniformly. Vibration is normally maintained until there is no appreciable further downward settlement after the mould has been completely filled and the material is effectively locked or arched in position almost regardless of further vibration. This stable "loose arched" condition is normally necessary to achieve a uniform degree of vibration pre-compaction throughout the depth of the mould. If the additional vibration time required to achieve this condition is too long (eg over 1 or 2 minutes) the time can be reduced by increasing the proportion of coarse particles. Excessive settling time can also be reduced by increasing the average size of fine particles (without blowing off the very fine particles). Alternatively, the filling rate can be slowed to more nearly match the natural settling rate for the particular mix and vibration rate being used, so that more time is allowed for air to escape from between the particles during filling.

After filling and settling, the mould is transferred to the core former pressure station, where the sleeves are inflated to about 50 psi. If the movement of the sleeves against the powder is too small to allow the formers to be withdrawn, the vibration amplitude may be too high for the particular mix being tested. If after reducing vibration the formers can be withdrawn but the formers shear off the powder webs lodged between them, the proportion of coarse particles may be too high, of the fines may not be quite cohesive enough, requiring further reduction in particle size.

At the other extreme, there may be too much sleeve movement under pressure, which can result in unduly thin webs and a generally weak powder structure, even if sleeve pressure is increased considerably. This is usually a sign of too low a proportion of coarse particles, which may also be accompanied by the average size of the fines being too small to settle effectively under vibration pre-compaction. As discussed earlier, it is possible to handle these less favourable mixes by slowing down the feed rate and increasing vibration amplitude, although in many cases, this can still result in finished panels with unsatisfactory strength and surface finish characteristics.

These procedures are very time consuming, as the right balance can only be found by a succession of trail runs. The large number of inter-related variables gives a very large number of possible combinations which do not work, and it may be this apparently high failure rate which explains why the present concept was not perceived earlier as a viable manufacturing method. Interspersed with the unsatisfactory combinations, however, are a much smaller number of highly satisfactory combinations which can work reliably under commercial conditions, and the final stage of optimisation involves narrowing these to those operating parameters which give the best quality of final product at the fastest production cycle times. Generally both of these requirements are best served by optimising particle size grading, rather than compensating for mix deficiency, by, for example, lengthening filling times or increasing vibration intensity.

Another major impediment to the development of the invention has been the need for highly specialised equipment to make the process work at all, and in the early stages of the development work no such plant existed.

The invention is not restricted to the exact features of the embodiment hereinbefore described since alternatives will readily present themselves to one skilled in the art. Thus, whilst the use of an inflatable sleeve represents a ready and effective means of achieving pressure compaction, other forms of expandable core formers may be preferred in some instances, including, for example, a segmented core former provided with wedge means whereby the same might be expanded laterally to apply a compressive force to the mix within the mould.

It will be seen that the invention permits of the creation of a stable, dry-powder product without need to recourse to the intense vibration of the methods disclosed in prior British Pat. Nos. 1346757, 2045150 and 2067125 by utilising a much lesser level of vibration to effect settling of the mix and uniform distribution of the elements thereof and effecting compaction by subjecting the precompacted mix to pressure of moderate proportions.

What is claimed is:

1. A method for the manufacture of cored construction products comprising dry particulate materials, comprising the steps of providing a mould having at least one core former therein, vibrating the mould, with means operating substantially in the axial direction of the at least one core former, whilst progressively filling the mould with an appropriate mix of the materials, applying pressure to the materials in the mould in a direction transversely of the at least one core former, thereafter withdrawing the at least one core former to leave a corresponding core void, and then applying a sufficient quantity of setting liquid to a free surface of the materials to give full impregnation thereof by capillary action, wherein the vibration of the mould is at relatively small intensities to effect pre-compaction of the materials whereby individual particles of the materials are rearranged into substantially uniform, more closely spaced disposition sufficient that upon the subsequent application of said pressure the materials are brought into a final compacted state without substantial redistribution or local crushing of the particles.

2. The method as claimed in claim 1 wherein the dry particulate materials include fibers.

3. The method as claimed in claim 1, wherein the pre-compacted materials are subjected to a pressure of between 15 psi and 100 psi, and preferably between 50 psi and 65 psi, to effect compaction thereof.

4. The method as claimed in claim 1, wherein the particulate materials are supplied to the mould at a filling rate of approximately 10 mm to 30 mm per second.

5. The method as claimed in claim 1, wherein an amplitude and a frequency of vibration of the mould are between 0.5 mm and 3 mm and between 300 cpm and 900 cpm, respectively.

6. The method as claimed in claim 5, wherein the mould is disposed substantially vertically and the vibration is in an upward direction in a plane of the mould, the vibration having a sharp termination of a downstroke thereof.

7. The method as claimed in claim 1, wherein the step of applying pressure to the pre-compacted material comprises expansion of the at least one core former.

8. The method as claimed in claim 7, wherein pressure is applied by expansion of an inflatable sleeve provided on the at least one core former.

9. The method as claimed in claim 8, including the further step of introducing a post-hydration former into the at least one core void subsequent to the impregnation step and expanding the at least one post-hydration former into pressure contact with a surface of the core void.

10. The method as claimed in any one of the preceding claims including the further step of supporting surfaces of the mould against deflection during the pressure compaction step.

11. The method as claimed in claim 10, wherein inflatable bodies are provided in register with the surfaces of the mould by inflation of such inflatable bodies into load bearing contact with the surfaces of the mould.

* * * * *